United States Patent [19]

McGrail et al.

[11] 4,252,885

[45] Feb. 24, 1981

[54] POLYESTER COATED FILMS USING AN AQUEOUS POLYESTER DISPERSION AND PHOTOGRAPHIC LAYER

[75] Inventors: Patrick T. McGrail, Bramford; David R. Mann, Colchester, both of England

[73] Assignee: Bexford Limited, London, England

[21] Appl. No.: 888,985

[22] Filed: Mar. 22, 1978

[30] Foreign Application Priority Data

Mar. 25, 1977 [GB] United Kingdom ..... 12617/77

[51] Int. Cl.[3] ..... G03C 1/78

[52] U.S. Cl. ..... 430/160; 430/532; 430/533; 430/534; 430/535

[58] Field of Search ..... 96/87 R; 430/532, 533, 430/534, 535, 160

[56] References Cited

U.S. PATENT DOCUMENTS

| | | | |
|---|---|---|---|
| 2,462,151 | 2/1949 | Woodward | 95/5 |
| 3,563,942 | 2/1971 | Heiberger | 260/75 |
| 3,615,554 | 10/1971 | Takenaka | 96/87 R |
| 3,941,727 | 3/1976 | Timmerman et al. | 96/87 R |
| 4,051,302 | 9/1977 | Mayama | 428/411 |
| 4,093,458 | 6/1978 | McGrail et al. | 96/87 R |

FOREIGN PATENT DOCUMENTS

| | | |
|---|---|---|
| 516815 | 4/1967 | Switzerland . |
| 562666 | 7/1944 | United Kingdom . |
| 700957 | 12/1953 | United Kingdom . |
| 820865 | 9/1959 | United Kingdom . |
| 1020054 | 12/1962 | United Kingdom . |
| 1014344 | 12/1965 | United Kingdom . |
| 1030753 | 5/1966 | United Kingdom . |
| 1078813 | 8/1967 | United Kingdom . |
| 1127925 | 9/1968 | United Kingdom . |
| 1167889 | 10/1969 | United Kingdom . |
| 1286457 | 10/1969 | United Kingdom . |
| 1333589 | 10/1973 | United Kingdom . |
| 1427026 | 3/1976 | United Kingdom . |
| 1441591 | 7/1976 | United Kingdom . |

*Primary Examiner*—Jack P. Brammer

*Attorney, Agent, or Firm*—Cushman, Darby & Cushman

[57] ABSTRACT

Light-sensitive photographic films are produced by coating polyester films with aqueous dispersions of polyesters or copolyesters containing free-functional acid groups. Corona discharge treatment of the polyester or copolyester layers is disclosed for direct adhesion to photographic emulsions or indirect adhesion via a polymeric sub and/or gelatin sub.

14 Claims, No Drawings

POLYESTER COATED FILMS USING AN AQUEOUS POLYESTER DISPERSION AND PHOTOGRAPHIC LAYER

The present invention relates to a process for the production of light-sensitive photographic films and to the resulting photographic films.

According to the present invention, a process for the production of a light-sensitive film comprises applying an aqueous dispersion of a synthetic polyester or copolyester which contains free-functional acid groups to one or both surfaces of a film of a synthetic linear polyester and applying a light-sensitive layer over one or both layers applied from the aqueous dispersion of the synthetic polyester or copolyester.

The invention also relates to a light-sensitive film which comprises a layer of a synthetic polyester or copolyester containing free-functional acid groups applied to one or both surfaces of a film of a synthetic linear polyester and a light-sensitive layer applied over one or both layers of the synthetic polyester or copolyester.

The light-sensitive layer may comprise a light-sensitive photographic emulsion, e.g. comprising a gelatinous silver halide emulsion, or a light-sensitive reprographic layer, e.g. a layer containing or impregnated with a light-sensitive diazonium salt.

The synthetic linear polyester film may be produced from a polyester obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic, acid, adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Polyethylene terephthalate is particularly useful for the production of light-sensitive photographic films according to the invention and may be biaxially oriented and heat set before the application of the aqueous dispersion, or alternatively the aqueous dispersion may be applied to the film surface before or during the stretching operations to which the film is subjected.

The polyester or copolyester of the aqueous dispersion should contain free acid groups, that is groups other than those involved in the condensation reaction by which the polyester or copolyester is formed, present in a quantity sufficient to maintain the polyester or copolyester suspended in the aqueous medium when wholly or partially converted to the salt form, e.g. by the addition of an alkali or amine, but in a quantity insufficient to render the polyester or copolyester soluble in an aqueous medium with or without the addition of alkali or amine. The free-functional acid groups may for example be carboxylic or sulphonic acid groups. The ability of a polyester or copolyester to form a dispersion or be completely dissolved in an aqueous medium may be expressed in terms of its "acid number" (determined as the amount of potassium hydroxide in milligrams required to neutralise one gram of polyester or copolyester). The actual acid number of a particular polyester or copolyester depends upon the nature of the polyester or copolyester structure, its molecular weight, and the nature and number of the free acid groups present. Polyesters and copolyesters having an acid number in the range 1 to 120 are particularly suitable for use in the aqueous dispersions employed according to this invention. Preferably, materials having an acid number less than 95 are used.

The coating polyester or copolyester in one embodiment of the invention may be produced from an organic acid having at least three functional acid groups, or a mixture of such acids. Alternatively, an acid anhydride or a lower alkyl (up to ten carbon atoms in the alkyl group) ester of the acid may be employed instead of the acid. Suitable acids, or the anhydrides or lower alkyl esters thereof, are trimellitic acid, pyromellitic acid, trimesic acid, sulphoterephthalic acid, sulphoisophthalic acid, sulphophthalic acid and benzo phenone tetra carboxylic acid. The anhydrides of trimellitic acid, pyromellitic acid, sulphophthalic acid and benzo phenone tetra carboxylic acid are useful reagents. The preferred reagents are trimellitic anhydride and sulphoterephthalic acid.

The acid or anhydride or lower alkyl ester may be condensed by conventional procedure with one or more glycols or a suitable material which acts as a glycol under reaction conditions for the production of the coating polyester or copolyester such as ethylene glycol, 1,3-butylene glycol, dipropylene glycol, 1,2-propylene glycol, diethylene glycol, polyethylene glycol, neopentyl glycol, 1,3-propanediol, 1,4-butanediol, 1,4-cyclohexanedimethanol, styrene oxide and phenyl glycidyl ether. The preferred materials are ethylene glycol, 1,3-butylene glycol, neopentyl glycol, 1,3-propanediol, 1,4-butanediol and 1,4-cyclohexanedimethanol.

If desired, the acid number of the polyester or copolyester may be modified by including one or more monohydric alcohols such as ethylene glycol monobutyl ether, tridecanol, butoxyethoxy propanol, benzyl alcohol, cyclohexanol and hexadecanol, and preferably benzyl alcohol or cyclohexanol, in the reaction mixture from which the polyester or copolyester is prepared in an amount sufficient to react with a chosen number of the pendant carboxyl groups in the polyester or copolyester structure.

Other properties of the coating polyester or copolyester such as hardness, tackiness, flexibility, solubility, hydrolytic resistance and glass-transition temperature may be modified, if desired, by the addition to the reaction mixture from which it is produced of one or more modifying agents such as difunctional acids, carboxy glycols, polyfunctional alcohols, amines, and aminoalcohols which function to wholly or partially replace the appropriate polyester component. Suitable modifying agents include isophthalic acid, terephthalic acid, phthalic anhydride, fumaric acid, maleic anhydride, chlorendic anhydride, tetrachlorophthalic anhydride, succinic acid, dimethylol propanoic acid, glycerol, ethanolamine, ethylene diamine and hexamethylene diamine, the preferred agents being isophthalic acid, terephthalic acid, phthalic anhydride, chlorendic anhydride, maleic anhydride and ethanolamine.

In a typical process for the production of the coating polyester or copolyester a stirred reaction vessel may be charged with the polyfunctional acid, its anhydride or lower alkyl ester or a mixture thereof, and the glycol(s), and when employed the monohydric alcohol(s) and/or the modifying agent(s). The charge is initially heated to a moderate temperature in the range 150° to 175° C. under a blanket of inert gas such as nitrogen until the vigorous evolution of water abates and the temperature is then gradually raised to between 170° to 235° C. until the desired acid number is reached, assessed by taking samples of the reaction mixture at regular intervals and titrating against dilute caustic potash solution. The charge is then allowed to cool and solidify prior to being dissolved in an amount of acetone or other suitable water miscible solvent just sufficient to achieve dissolution. The solution of polyester is poured with rapid stirring into an appropriate quantity of water to give a dispersion of the desired solids content. The water should contain sufficient alkali or amine, preferably ammonia, to neutralise a sufficient number of acid groups to form a stable dispersion. The mixture can be heated to about 60° to 70° C. or to a lower temperature under reduced pressure, to remove residual acetone or solvent and this process may be assisted by the passage of nitrogen or air through the aqueous dispersion.

When a modifying agent is used it is preferably reacted with the glycol and optionally with the monohydric alcohol before the remainder of the reaction charge is added.

The polyester or copolyester may have a molecular weight in the range 500 to 50,000.

Especially effective coating polyesters or copolyesters may be prepared by the reaction of the following materials:

Trimellitic anhydride with ethylene glycol and benzyl alcohol;

Trimellitic anhydride with ethylene glycol, isophthalic acid and benzyl alcohol;

Trimellitic anhydride with ethylene glycol, chlorendic anhydride, and benzyl alcohol;

Trimellitic anhydride with 1,2-propanediol and cyclohexanol; and

Sulphoterephthalic acid with ethylene glycol, isophthalic acid, terephthalic acid and neopentyl glycol.

The resistance of the polyester or copolyester layer to attack by solvents and/or photographic and reprographic processing solutions may be improved by cross-linking the polyester or copolyester. Any of the known cross-linking agents which act by reaction with free-functional acid or hydroxyl groups may be added to the coating compositions, e.g. organic titanates, epoxy containing resins, formaldehyde generating agents and methylol-containing materials such as melamine/formaldehyde compounds. It may be necessary to accelerate the cross-linking reaction by adding a suitable catalyst to the coating composition, e.g. citric acid, ammonium chloride, and p-toluene sulphonic acid. Up to 10% by weight of the cross-linking agent based on the weight of the polyester or copolyester has been found to be effective but higher levels may be used.

The polyester or copolyester dispersion may also contain other resins in dispersion, water-soluble resins and chemicals or colloids which will act as adhesion promoters, dispersion stabilisers, or viscosity modifiers. Such materials are typified by vinylidene chloride copolymers, vinyl chloroacetate copolymers, gelatin and p-chlororesorcinol which function as adhesion promoters; polyvinyl alcohol and cellulose ethers which function as dispersion stabilisers and viscosity modifiers; and polyvinyl pyrrolidone which functions as an adhesion promoter and viscosity modifier. The preferred additives are gelatin and vinyl chloroacetate copolymers.

The coating polyester or copolyester may be applied to the polyester film at any suitable stage during the production of the film, e.g. before or during the stretching operations which are conventionally employed for molecularly orienting the film, or independently of the production of the film, i.e. after stretching and heat setting the film.

In a typical process for the production of a molecularly oriented polyester film, the polyester is melt extruded through a slit die, quenched to the amorphous state, oriented by stretching in one or more directions, e.g. in the direction of extrusion and then in the direction transverse thereto, followed by heat setting under dimensional restraint. Such a process is described in British patent specification No. 838 708. In such a process, the coating may be applied before stretching in the longitudinal direction, usually the direction of extrusion, or alternatively after stretching in the longitudinal direction and before stretching in the transverse direction. When coating in such a manner, it is not necessary to pretreat the film surface with a material having a solvent or swelling action upon the film as is the practice with other known coating operations since adequate adhesion of the polyester or copolyester layer and subsequently applied layers coatings can be obtained without pretreatment.

Even when the coating polyester or copolyester is applied to the film surface independently of the production of the film its adhesion and the adhesion of subsequently applied layers to the film surface is satisfactory without any pretreatment with materials having a solvent or swelling action on the film. Thus, for example, it has been common practice in the photographic industry to pretreat the surface of polyester films with halogenated phenols in order to promote the adhesion of photographic layers to the film. Such halogenated phenols are unpleasant to use because of their smell and toxicity; they may also adversely affect some photographic layers. The polyester and copolyester layers of this invention can be employed as primer layers for subsequently applied photographic layers without using a halogenated phenol pretreatment thereby avoiding the problems associated with their use.

On the other hand, it has been found that the polyester and copolyester layers of this invention adhere satisfactorily to polyester film surfaces which have been pretreated with materials having a solvent or swelling action on the film, including halogenated phenols, and therefore, if desired, the layers may be applied to the surface of a polyester film which has been pretreated with such a solvent or swelling agent, e.g. a solution in a common volatile organic solvent such as acetone or methanol of o-chlorophenol, p-chlorophenol, 2:4-dichlorophenol, 2:4:5- or 2:4:6-trichlorophenol, p-chloro-m-cresol or 4-chlororesorcinol or a mixture of one or more of these materials.

The polyester or copolyester layers may be applied by any suitable known technique for coating film surfaces. Layers having a dry coat weight in the range 0.1 to 10.0 mg/dm$^2$ and preferably 1.0 to 2.0 mg/dm$^2$ are especially suitable.

In the production of the light-sensitive films according to this invention a light-sensitive layer, such as a photographic layer, may be applied over the polyester or copolyester layer, optionally with the interposition of one or more adhesion-promoting or subbing layers between the polyester or copolyester layer and the light-sensitive layer. Thus, according to one embodiment of the invention, the polyester or copolyester layer may be coated with a conventional gelatin subbing layer followed by a conventional gelatinous silver halide photographic emulsion. Alternatively, a polymeric or copolymeric subbing layer may be applied to the polyester or copolyester layer followed by a gelatinous silver halide emulsion, optionally with a gelatin subbing layer located between the polyester or copolyester layer and the silver halide emulsion.

The surface of the applied polyester or copolyester layer may be subjected to a modifying treatment, if desired, to improve its adhesion to subsequently applied layers. A preferred modifying treatment comprises corona discharge treatment which may be effected in air at atmospheric pressure with conventional equipment using a high frequency, high voltage generator, preferably having a power output of from 1 to 20 kw at a potential of 1 to 100 kv. Discharge is conveniently accomplished by passing the film over a dielectric support roller at the discharge station at a linear speed preferably of 1.0 to 500 m per minute. The discharge electrodes may be positioned 0.1 to 10.0 mm from the moving film surface.

Corona discharge treatment of the polyester or copolyester layer may be employed in embodiments of the invention wherein (i) a light-sensitive photographic emulsion is adhered directly to the corona discharge treated polyester or copolyester layer, (ii) a gelatin subbing layer is adhered directly to the corona discharge treated polyester or copolyester layer and a light-sensitive photographic emulsion adhered to the gelatin subbing layer or (iii) a polymeric or copolymeric subbing layer is adhered directly to the corona discharge treated polyester or copolyester layer and a gelatin subbing layer followed by a light-sensitive photographic emulsion layer are applied over the polymeric or copolymeric subbing layer.

When a polymeric or copolymeric subbing layer is employed it may be applied to the polyester or copolyester layer by any suitable known coating technique. The subbing polymers or copolymers may be applied as aqueous dispersions, suitable polymers and copolymers being vinyl chloroacetate copolymers, vinylidene chloride copolymers. Alternatively, the subbing polymer or copolymer may be applied as a solution in an organic solvent, suitable polymers and copolymers being vinyl chloroacetate/vinyl alcohol copolymers, vinyl chloroacetate/maleic anhydride copolymers or an admixture of a copolymer of a vinyl halogenoester with a carboxylic acid anhydride and a polyurethane resin. The preferred subbing copolymers are a vinyl chloroacetate/ethyl acrylate/acrylamide (78/7/15 mole %) copolymer and a vinylidene chloride/ethyl acrylate/itaconic acid (88/10/2 mole %) copolymer. The synthetic polymeric or copolymeric subbing layer may have a final dry coat weight in the range 0.1 to 10.0 $mg/dm^2$ and preferably in the range 1.0 to 2.0 $mg/dm^2$.

The adhesion of the polymeric or copolymeric subbing layer, when present, to subsequently applied layers may be further improved by subjecting its surface to a modifying treatment, e.g. by corona discharge treatment using the apparatus and conditions described above.

When a gelatin subbing layer is employed in the production of light-sensitive photographic films it may be applied from an organic solvent or water by any of the well-known processes for coating to give a final dry coat weight which would typically be in the range 0.1 to 3.0 $mg/dm^2$. The gelatin subbing layer may be dried by heating at a temperature of up to 150° C. but more commonly at 70° to 120° C.

The gelatin subbing layer may also contain such materials as polyvinyl acetate or particulate materials such as silica to lower the surface friction of the coated film and act as an anti-blocking agent and in addition may contain one of the well-known cross-linking agents for gelatin such as formalin. In the course of completion of the final photographic film element an anti-static agent may be applied, coated on top of or in admixture with the gelatin subbing layer.

If desired, gelatin may be included in the polyester or copolyester coating and a gelatinous light-sensitive emulsion applied directly over it, or to a gelatin subbing layer interposed therebetween.

In a further embodiment, a coating suitable for the production of a light-sensitive reprographic film comprising a resinous binder containing or impregnated with a light-sensitive diazonium salt may be applied to the polyester or copolyester layer, if desired with a conventional polymeric or copolymeric adhesion-promoting layer interposed therebetween. Resinous binders suitable for inclusion in such coating include cellulose acetate, cellulose acetate propionate, cellulose acetate butyrate and polymers and copolymers of vinyl acetate which may optionally be partially hydrolysed. Particularly suitable polyester coatings for the production of light-sensitive reprographic films are aqueous dispersions of a polyester of isophthalic acid and diethylene glycol preferably containing 2 to 10% by weight based upon the weight of the polyester of a cross-linking agent such as a methoxy modified melamine formaldehyde condensate. Suitable polyester dispersions include those which are commercially available as 'Eastman Binder' DFB and 'Eastman WD Size' which may be used alone or in admixture. When 'Eastman WD Size' is not used in admixture with 'Eastman Binder' DFB, the aqueous dispersion preferably also contains 2 to 10% by weight based upon the weight of the solids content of the 'Eastman WD Size'.

'Eastman Binder' DFB amd 'Eastman WD Size' have been shown by analysis to have the following composition:

'Eastman Binder' DFB—aqueous suspension comprising 27% by weight of a polyester of isophthalic acid, diethylene glycol and a sulpho derivative of a dicarboxylic acid possibly sulphoterephthalic acid or sulphoisophthalic acid and 3% by weight of a methoxy modified melamine formaldehyde.

'Eastman WD Size'—aqueous suspension comprising 30% by weight of a polyester of isophthalic acid, diethylene glycol and a sulpho derivative of a dicarboxylic acid possibly sulphoterephthalic acid or sulphoisophthalic acid.

The invention is further described in the following examples.

EXAMPLE 1

A reaction vessel fitted with a stirrer, a thermometer, a nitrogen bleed, a fractional distillation assembly and a heater was charged with 3.0 mole of trimellitic anhydride (576.3 g), 3.0 mole of ethylene glycol (186.3 g) and 3.0 mole of benzyl alcohol (324.3 g). The reaction mixture was heated to 150° C. and maintained at this temperature with stirring for 4 hours, by which time the distillation of water had commenced. Over the next 9 hours the temperature was gradually raised to 190° C. by which time the distillation rate had slowed down. The fractionating column was removed and heating continued for a further 5 hours, allowing the temperature to slowly rise to 205° C. At this point the resultant polyester had an acid number of about 55. The polyester was then poured into a polytetrafluoroethylene-lined tray where it was allowed to cool and solidify.

200 g of the reaction product were dissolved in 500 ml of acetone and slowly poured with rapid stirring into a solution of 2000 ml of distilled water containing 200 ml of 1.0 molar aqueous ammonia solution. This mixture was filtered and then heated to 60° C. to remove the acetone. The resulting polyester dispersion was diluted to a concentration of 3.0 g of solids in 100 ml of aqueous medium.

An amorphous polyethylene terephthalate film was stretched about three times its original dimensions in one direction and coated on both sides with the aqueous polyester dispersion and dried. The coated film was stretched about three times its original dimensions in the direction perpendicular to the first direction of stretching, and heat set whilst held under dimensional restraint. The polyester layer on each side of the film had a dry coat weight of approximately 0.3 mg/dm$^2$.

The pretreated film thus obtained was then coated on both sides with an aqueous dispersion comprising 1.0 g of a copolymer prepared from 78 mole % of vinyl chloroacetate, 7 mole % of acrylamide and 15 mole % of ethyl acrylate per 100 ml of water. After drying for 2 minutes at 80° C. this coating had a final dry coat weight of between 1.0 and 2.0 mg/dm$^2$ on each side of the film. The coated surfaces of the film were then coated with a gelatin subbing solution comprising 1.0 g of gelatin per 100 ml of water. After drying for 3 minutes at 105° C. the gelatin subbing layer had a dry coat weight of approximately 2.0 mg/dm$^2$ on each side of the film, of even quality and free from retraction spots.

Finally the gelatin subbing layers were coated on both sides of the film with a photographic gelatino-silver halide X-ray emulsion. The film was chilled to gel the coatings and dried for 20 minutes at 40° C. After being incubated at 50° C. and 76% relative humidity for 18 hours the coating layers of the photographic film element thus obtained had excellent adhesion via the polyester pretreatment layer to the underlying film before, during and after processing in photographic developers such as those commonly used for manual and machine processing.

No adverse sensitometric or coating quality effects were observed in the photographic emulsion.

EXAMPLE 2

A sample of the polyester layer pretreated polyethylene terephthalate film prepared as described in Example 1 was coated on both sides directly with a gelatin subbing solution of the composition described in Example 1 and dried for 3 minutes at 105° C. A photographic gelatino-silver halide X-ray emulsion was coated onto both sides of the subbed film as described in Example 1.

The coating layers of the photographic film element thus obtained had firm adhesion via the polyester pretreatment layer to the underlying film before, during and after processing in photographic developers.

No adverse sensitometric or coating quality effects were observed in the photographic emulsion.

EXAMPLE 3

An amorphous polyethylene terephthalate film was stretched about three times its original dimensions in one direction and coated on both sides with an aqueous dispersion comprising 2.0 g of the coating polyester prepared in Example 1 and 0.2 g of gelatin per 100 ml of water. The coated film was stretched about three times its original dimensions in the direction perpendicular to the first direction of stretching, heat set whilst held under dimensional restraint and dried. The polyester/gelatin layer on each side of the film had a dry coat weight of approximately 0.4 mg/dm$^2$.

The polyester/gelatin layers were coated directly with gelatin subbing solutions of the composition described in Example 1 and dried for 3 minutes at 105° C. A photographic gelatino-silver halide X-ray emulsion was coated on both sides of the subbed film and gelled and dried, as described in Example 1.

The coating layers of the photographic film element thus obtained had firm adhesion via the polyester pretreatment layer to the underlying film before, during and after processing in photographic developers.

No adverse sensitometric or coating quality effects were observed in the photographic emulsion.

EXAMPLE 4

A conventionally biaxially oriented and heatset polyethylene terephthalate film, 175 microns thick, was pretreated on both sides with a solution comprising 2.0 g of p-chloro-m-cresol dissolved in 100 ml of methanol to give a wet coat weight of 2.0 mg/dm$^2$ of the p-chloro-m-cresol and dried for 2 minutes at a temperature between 60° and 80° C. to give a residual dry coat weight of from 0.1 to 0.5 mg/dm$^2$ per side of film. The pretreated film was then coated on both sides with an aqueous dispersion comprising 1.0 g of the polyester prepared as described in Example 1 per 100 ml of water. After drying for 2 minutes at 80° C. this coating had a final dry coat weight of between 1.0 to 2.0 mg/dm$^2$ on each side of the film.

The coated surfaces of the film were then subbed with a gelatin subbing solution of the composition described in Example 1 and dried for 3 minutes at 105° C. to give a dry coat weight of approximately 2.0 mg/dm$^2$ on each side of the film, of even quality and free from retraction spots.

Finally the gelatin subbed film was coated on both sides with a photographic gelatino-silver halide X-ray emulsion as described in Example 1 and chilled to gel the coatings and dried for 20 minutes at 40° C.

The coating layers of the photographic film element thus obtained had firm adhesion via the polyester pretreatment layer to the underlying film before, during and after processing in photographic developers without any adverse sensitometric or coating quality effects.

EXAMPLE 5

A conventionally biaxially oriented and heatset polyethylene terephthalate film, 175 microns thick, was pretreated on both sides with an aqueous dispersion comprising 1.0 g of the polyester prepared as described in Example 1 per 100 ml of water and dried for 2 minutes at 80° C. to provide a dry coat weight of between 1.0 and 2.0 mg/dm$^2$ on each side of the film.

The coated surfaces of the film were then coated with a gelatin subbing solution of the composition described in Example 1 and dried for 3 minutes at 105° C. to provide a dry coat weight of approximately 2.0 mg/dm$^2$ on each side of the film, of even quality and free from retraction spots.

The gelatin subbed film was coated on both sides with a photographic gelatino-silver halide X-ray emulsion, chilled to gel the coating and dried for 20 minutes at 40° C. as described in Example 1.

The coating layers of the photographic film element thus obtained had firm adhesion via the polyester pretreatment layer to the underlying film before, during and after processing in photographic developers without any adverse sensitometric or coating quality effects.

EXAMPLE 6

An amorphous polyethylene terephthalate film was stretched about three times its original dimensions in one direction and coated on both sides with an aqueous dispersion comprising 3.0 g of an aqueous polyester suspension which is commercially available as 'Eastman Binder' DFB in 100 ml of water and dried. The coated film was stretched about three times its original dimensions in the direction perpendicular to the first direction of stretching, and heat set whilst held under dimensional restraint to provide a polyester layer on each side of the film having a dry coat weight of approximately 0.3 mg/dm$^2$.

The polyester pretreatment layers on each side of the film were further coated in order with layers of the vinyl chloroacetate copolymer, the gelatin subbing composition and the gelatino-silver halide X-ray emulsion of the compositions and by the procedure specified in Example 1.

The coating layers of the resulting photographic film element had good adhesion via the copolyester pretreatment layers to the underlying film before, during and after processing in photographic developers without any adverse sensitometric or coating quality effects.

EXAMPLE 7

An amorphous film of polyethylene terephthalate was stretched about three times its original dimensions in one direction and coated on both sides with the aqueous dispersion of polyester followed by stretching in the transverse direction and heat setting as described in Example 1.

The pretreated film was coated on both sides with an aqueous dispersion comprising 1.0 g of a copolymer prepared from 88 mole % of vinylidene chloride, 10 mole % of methyl acrylate and 2 mole % of itaconic acid per 100 ml of water and dried for 2 minutes at 80° C. to a dry coat weight of 1.0 to 2.0 mg/dm$^2$ on each side of the film.

The vinylidene chloride copolymer layers were then coated with gelatin subbing layers and gelatino-silver halide emulsions of the compositions and by the procedure specified in Example 1.

The coating layers of the resulting photographic film element had good adhesion via the copolyester pretreatment layers to the underlying film before, during and after processing in photographic developers without any adverse sensitometric or coating quality effects.

EXAMPLE 8

An aqueous polyester pretreatment dispersion was prepared from 1.0 mole of trimellitic anhydride (192.1 g), 2.0 mole of chlorendic anhydride (741.6 g), 3.0 mole of butane-1,3-diol (270.0 g) and 3.0 mole of benzyl alcohol (324.3 g) at a concentration of 1.0 g of solids in 100 ml of aqueous medium.

A conventionally biaxially oriented and heatset polyethylene terephthalate film, 175 microns thick, was pretreated on both sides with the polyester dispersion as prepared above and dried for 2 minutes at 80° C. to provide a dry coat weight of between 1.0 and 2.0 mg/dm$^2$ on each side of the film.

The polyester pretreatment layers were then further coated with the vinyl chloroacetate copolymer, gelatin subbing and gelatinous silver halide emulsion layers in accordance with Example 1.

The coating layers of the resulting photographic film element had good adhesion via the copolyester pretreatment layers to the underlying film before, during and after processing in photographic developers without any adverse sensitometric or coating quality effects.

EXAMPLE 9

An amorphous film of polyethylene terephthalate was stretched about three times its original dimensions in one direction and coated on both sides with an aqueous dispersion of a copolymer of 88 mole % of vinylidene chloride with 12 mole % of acrylonitrile followed by stretching about three times its original dimensions in the transverse direction and heat setting whilst held under dimensional restraint to give a dried copolymer coat weight of 0.3 mg/dm$^2$ on both sides of the film.

The film was then coated on both sides with an aqueous dispersion of the coating polyester prepared as described in Example 1 at a concentration of 1.0 g of solids in 100 ml of aqueous medium and dried for 2 minutes at 80° C. to a final dry coat weight of between 1.0 and 2.0 mg/dm$^2$ on each side of the film.

The polyester pretreatment layers were then further coated with gelatin subbing and gelatinous silver halide emulsion layers in accordance with Example 1.

The coating layers of the resulting photographic film element had good adhesion via the copolyester pretreatment layers to the underlying film before, during and after processing in photographic developers without any adverse sensitometric or coating quality effects.

EXAMPLE 10

The polyester layers of a sample of the pretreated film prepared as in Example 1 were subjected to a corona discharge treatment in air at atmospheric pressure using a commercially available Vetaphone 3 kw treater and then coated directly with a gelatin subbing layer composition and a photographic gelatino-silver halide X-ray emulsion layer in accordance with Example 1. The coating layers of the photographic film element thus obtained had acceptable adhesion via the polyester pretreatment layer to the underlying film before, during and after processing in photographic developers without any adverse sensitometric or coating quality effects.

EXAMPLE 11

A conventionally biaxially oriented and heatset polyethylene terephthalate film, 175 microns thick, was pretreated on both sides with a composition comprising an aqueous dispersion of a mixture of 1.0 g of the coating polyester prepared as described in Example 1 and 1.0 g of copolymer prepared from 78 mole % of vinyl chloroacetate, 7 mole % of acrylamide and 15 mole % of ethyl acrylate per 100 ml of water and dried for 2 minutes at 80° C. to give a dry coat weight of between 2.0 and 3.0 mg/dm$^2$ on each side of the film. The coated surfaces of the film were then further coated with a gelatin subbing layer and a photographic gelatino-silver halide X-ray emulsion in accordance with Example 1.

The coating layers of the resulting photographic film element had good adhesion via the copolyester pretreatment layers to the underlying film before, during and after processing in photographic developers without any adverse sensitometric or coating quality effects.

EXAMPLE 12

A sample of the polyester pretreated and biaxially oriented polyethylene terephthalate film prepared as described in Example 1 was further coated on both sides with a subbing solution comprising a mixture of 0.75 g of a copolymer of vinyl monochloroacetate (55 mole %) and vinyl alcohol (45 mole %), 0.007 g of hexamethoxymethyl-melamine, 0.007 g of p-toluene sulphonic acid, 97 ml of acetone and 3 ml of cyclohexanol and dried for 2 minutes at 80° C. to give a dry coat weight per side of approximately 2.0 mg/dm$^2$.

The coated film surfaces were further coated with a gelatin subbing solution comprising 1.2 g of gelatin, 5.0 ml of water, 1.0 ml of glacial acetic acid, 94.0 ml of methanol and 0.05 g of 'Mowilith' 70 (polyvinyl acetate). 'Mowilith' is a registered Trade Mark. After drying for 3 minutes at 105° C. the gelatin subbing layers had dry coat weights of approximately 2.0 mg/dm$^2$ on each side of the film and were of even quality and free from retraction spots.

Finally the gelatin subbed film was coated on both sides with a photographic gelatino-silver halide X-ray emulsion, chilled to gel the coatings and dried for 20 minutes at 40° C.

The coating layers of the resulting photographic film element had good adhesion via the copolyester pretreatment layers to the underlying film before, during and after processing in photographic developers without any adverse sensitometric or coating quality effects.

EXAMPLE 13

An oriented polyethylene terephthalate film coated on both sides with gelatin subbing layers was prepared as described in Example 1 and coated on one side with a conventional photographic gelatino-silver halide lith emulsion and on the other side with a conventional anti-halo backing. The film was chilled to gel the coatings and dried for 20 minutes at 40° C.

The coating layers of the resulting photographic film element had good adhesion via the copolyester pretreatment layers to the underlying film before, during and after processing in photographic developers without any adverse sensitometric or coating quality effects.

EXAMPLE 14

Using a preparative method similar to that described in Example 1, an aqueous polyester pretreatment dispersion was prepared from 1.0 mole maleic anhydride (98.1 g), 0.75 mole phthalic anhydride (111.1 g), 0.25 mole trimellitic anhydride (48.0 g) and 2.20 mole of propane-1,2-diol (167.4 g), the polyester having an acid number of 52.8 and the dispersion being prepared at a concentration of 1.0 g of solids in 100 ml of aqueous medium.

A conventionally biaxially oriented and heatset polyethylene terephthalate film, 175 microns thick, was pretreated on both sides with the polyester dispersion as prepared above and dried for 2 minutes at 80° C. to provide a dry coat weight of between 1.0 and 2.0 mg/dm$^2$ on each side of the film.

The polyester pretreatment layers were then further coated in order with layers of the vinyl chloroacetate copolymer, gelatin subbing composition and gelatino-silver halide X-ray emulsion of the compositions and by the procedure specified in Example 1.

The coating layers of the resulting photographic film element had good adhesion via the copolyester pretreatment layers to the underlying film before, during and after processing in photographic developers without any adverse sensitometric or coating quality effects.

EXAMPLE 15

Using a preparative method similar to that described in Example 1, an aqueous polyester pretreatment dispersion was prepared from 1.05 mole trimellitic anhydride (101 g), 1.0 mole propane-1,2-diol (38 g) and 1.0 mole 2-butoxy ethanol (59 g), the polyester having an acid number of 61 and the dispersion being prepared at a concentration of 1.0 g of solids in 100 ml of aqueous medium.

A conventionally biaxially oriented and heatset polyethylene terephthalate film, 175 microns thick, was pretreated on both sides with the polyester dispersion prepared above and dried for 2 minutes at 80° C. to provide a dry coat weight of between 1.0 and 2.0 mg/dm$^2$ on each side of the film.

A sample of this polyester pretreated and biaxially oriented polyethylene terephthalate film prepared was further coated on both sides with a subbing solution comprising a mixture of 0.5 g of a copolymer of vinyl monochloroacetate (40 mole %), methyl methacrylate (52 mole %) and maleic anhydride (8 mole %), 0.5 g of a polyurethane resin prepared from polyethylene adipate (1 mole), 1,4-butane diol (1.0 mole) and tolylene diisocyanate (2.0 mole), 0.004 g hexamethoxymethyl melamine, 0.0013 g of p-toluene sulphonic acid, 97 ml of acetone and 3 ml of diacetone alcohol and dried for 2 minutes at 80° C. to give a dry coat weight per side of approximately 2.5 mg/dm$^2$.

The coated film surfaces were further coated with a gelatin subbing solution comprising 1.2 g of gelatin, 5.0 ml of water, 1.0 ml of glacial acetic acid, 2.0 ml of benzyl alcohol and 94 ml of methanol. After drying for 3 minutes at 105° C. the gelatin subbing layers had dry coat weights of approximately 2.0 mg/dm$^2$ on each side of the film and were of even quality and free from retraction spots.

Finally the gelatin subbed film was coated on both sides with a photographic gelatino-silver halide X-ray emulsion, chilled to gel the coatings and dried for 20 minutes at 40° C.

The coating layers of the resulting photographic film element had good adhesion via the copolyester pretreatment layers to the underlying film before, during and after processing in photographic developers without any adverse sensitometric or coating quality effects.

EXAMPLE 16

The apparatus described in Example 1 was charged with 0.33 mole isophthalic acid (55.3 g) and 1.00 mole ethylene glycol (62.1 g) and this mixture was heated at 190° to 200° C. for 12 hours. A charge of 0.67 mole trimellitic anhydride (128.1 g) was added and heating continued for 4 hours, by which time the temperature had risen to 210° C. After a further 3 hours heating the temperature had fallen to 180° C. and a final charge of 0.5 mole benzyl alcohol (55.0 g) was added to the reaction vessel. The temperature was slowly increased to 210° C. and maintained at this level for 6 hours. At this point the resultant polyester had an acid number of 71. The polyester was then poured into a polytetrafluoroethylene-lined tray where it was allowed to cool and solidify. The product was a pale yellow, clear, glassy solid.

A polyester dispersion was prepared from this material by the method described in Example 1 and diluted with water to a concentration of 1.0 g of solids per 100 ml of water.

A conventionally biaxially oriented and heatset polyethylene terephthalate film, 175 microns thick, was pretreated on both sides with this aqueous dispersion of the polyester and dried for 2 minutes at 80° C. to provide a dry coat weight of between 1.0 and 2.0 mg/dm$^2$ on each side of the film.

The polyester pretreatment layers were then further coated with the vinyl chloroacetate copolymer, gelatin subbing and gelatino-silver halide emulsion layers in accordance with Example 1.

The coating layers of the resulting photographic film element had good adhesion via the copolyester pretreatment layers to the underlying film before, during and after processing in photographic developers without any adverse sensitometric or coating quality effects.

EXAMPLE 17

The apparatus described in Example 1 was charged with 0.79 mole phthalic anhydride (116.2 g) and 0.89 mole neopentyl glycol (92.0 g) and this mixture was heated at 200° C. for 16 hours. The temperature was then reduced to 180° C. and a charge of 0.10 mole pyromellitic anhydride (25.8 g) was added and heating continued at 180° C. for a further 4 hours. The temperature was raised to 210° C. and heating continued for a further 1 hour. At this point the resultant polyester had an acid number of 51 and the reaction was terminated. The polyester was then poured into a polytetrafluoroethylene-lined tray where it was allowed to cool and solidify. The product was a light brown, clear, glassy solid.

A polyester dispersion was prepared from this material by the method described in Example 1 and diluted with water to concentration of 1.0 g of the polyester per 100 ml of water.

A conventionally biaxially oriented and heat-set polyethylene terephthalate film, 175 microns thick, was pretreated on both sides with this aqueous dispersion and dried for 2 minutes at 80° C. to provide a dry coat weight of between 1.0 and 2.0 mg/dm$^2$ on each side of the film.

The pretreated film was coated on both sides with an aqueous dispersion comprising 1.0 g of the copolymer prepared from 88 mole % of vinylidene chloride, 10 mole % of methyl acrylate and 2 mole % of itaconic acid per 100 ml of water and dried for 2 minutes at 80° C. to give a dry coat weight of 1.0 to 2.0 mg/dm$^2$ on each side of the film.

The vinylidene chloride copolymer layers were then coated with gelatin subbing layers and gelatino-silver halide emulsion of the compositions and by the procedures specified in Example 1.

The coating layers of the resulting photographic film element had good adhesion via the copolyester pretreatment layers to the underlying film before, during and after processing in photographic developers without any adverse sensitometric or coating quality effects.

EXAMPLE 18

The apparatus described in Example 1 was charged with 1.3 mole isophthalic acid (221 g) and 2.3 mole of 1,4-butane diol (207 g) and this mixture was heated at 190° to 200° C. for 12 hours. A further charge of 1 mole trimellitic anhydride (192 g) was added and heating continued for 6 hours, by which time the temperature had risen to 205° C. After a further 4 hours heating the temperature had fallen to 180° C. and a final charge of 0.25 mole cyclohexanol (25 g) was added to the reaction vessel. The temperature was slowly increased to 205° to 210° C. and maintained at this level for 10 hours. At this point the resultant polyester had an acid number of 75. The polyester was then poured into a polytetrafluoroethylene-lined tray where it was allowed to cool and solidify. The product was a dark yellow, clear, glassy solid.

A polyester dispersion was prepared from this material by the method described in Example 1 and after dilution with water to a concentration of 1.0 g of polyester per 100 ml of water, 0.052 g of triethanolamine titanate was added.

A conventionally biaxially oriented and heat-set polyethylene terephthalate film, 175 microns thick, was pretreated on both sides with this aqueous dispersion and dried for 2 minutes at 80° C. to provide a dry coat weight of between 1.0 and 2.0 mg/dm$^2$ on each side of the film.

The polyester pretreatment layers were then further coated with the vinyl chloroacetate copolymer, gelatin subbing and gelatino-silver halide emulsion layers in accordance with Example 1.

The coating layers of the resulting photographic film element had good adhesion via the copolyester pretreatment layers to the underlying film before, during and after processing in photographic developers without any adverse sensitometric or coating quality effects.

EXAMPLE 19

An amorphous polyethylene terephthalate film was stretched about three times its original dimensions in one direction and coated on both sides with an aqueous dispersion comprising 3.0 g of an aqueous polyester suspension which is commercially available as 'Eastman Binder' DFB in 100 ml of water and dried. The coated film was stretched about three times its original dimensions in the direction perpendicular to the first direction of stretching, and heat set whilst held under dimensional restraint to provide a copolyester coating on each side of the film having a dry coat weight of approximately 0.3 mg/dm$^2$.

The copolyester layers of the film were treated with corona discharge in air at atmospheric pressure using a commercially available Vetaphone 3 kw treater before being immediately coated on both sides with a gelatin subbing composition followed by a gelatino-silver halide X-ray emulsion of the compositions and by the procedures specified in Example 1.

The coating layers of the resulting photographic film element were tested for normal wet and dry adhesions after incubation for 16 hours at 70% relative humidity and 50° C. by the following procedure with the results shown in Table 1.

"Normal dry adhesion" refers to the adhesion of the gelatino-silver halide photographic emulsion in the final photographic film assembly assessed, both before and after processing in standard photographic chemicals, by sticking adhesive tape along a torn edge of the film and then ripping the adhesive tape off. The adhesion of the emulsion is graded from 1 to 5, Grade 1 being when no emulsion is removed after 8 pulls of the tape and Grade 5 being when all the emulsion is removed with one pull, intermediate grades relating to progressive adhesion deterioration between Grades 1 and 5.

"Normal wet adhesion" refers to the adhesion of the gelatino-silver halide photographic emulsion in the final photographic film assembly, assessed, after processing in the standard photographic chemicals and washing in water for 15 minutes, by rubbing with a sponge over a series of lines scored in the still wet emulsion. The adhesion of the emulsion is graded from 1 to 5, Grade 1 being when no emulsion is removed from edges of the score line by 10 rubs with the sponge and Grade 5 being when all the emulsion is removed between the score lines by 10 rubs, intermediate grades relating to progressive adhesion deterioration between Grades 1 and 5.

TABLE 1

| Adhesion of X-ray emulsion after incubation | | |
|---|---|---|
| Normal dry adhesion before processing | Normal dry adhesion after processing | Normal wet adhesion |
| Grade 1 | Grade 1 | Grade 1 |

EXAMPLE 20

An amorphous film of polyethylene terephthalate was stretched about three times its original dimensions in one direction and coated on both sides with a polyester dispersion prepared as described in Example 15 and containing 0.1 g of gelatin dissolved in 100 ml of the aqueous dispersion and dried. The coated film was stretched about three times its original dimensions in the direction perpendicular to the first direction of stretching, and heat set whilst held under dimensional restraint to provide a coating of the polyester and gelatin mixture on each side of the film having a dry coat weight of approximately 0.3 mg/dm$^2$.

The polyester gelatin layers of the pretreated film were treated with corona discharge in air at atmospheric pressure using a commercially available Vetaphone 3 kw treater before being immediately coated on both sides with a gelatin subbing composition followed by a gelatino-silver halide X-ray emulsion of the compositions and by the procedures specified in Example 1.

The coating layers of the resulting photographic film element were tested after incubation for 16 hours at 70% relative humidity and 50° C. for normal wet and dry adhesions by the methods specified in Example 19 and with the results shown in Table 2.

TABLE 2

| Adhesion of X-ray emulsion after incubation | | |
|---|---|---|
| Normal dry adhesion before processing | Normal dry adhesion after processing | Normal wet adhesion |
| Grade 2 | Grade 2 | Grade 1 |

EXAMPLE 21

A sample of a polyester pretreated polyethylene terephthalate film similar to that prepared in Example 19 with the exception that the polyester coating on each side of the film had a dry coat weight of approximately 1.5 mg/dm$^2$ was treated on both sides with corona discharge in air at atmospheric pressure using a commercially available Vetaphone 3 kw treater and immediately coated on both sides with a photographic gelatino-silver halide X-ray emulsion. The film was chilled to gel the coatings and dried for 20 minutes at 40° C.

The coating layers of the resulting photographic film element were tested for normal wet and dry adhesions by the methods specified in Example 19 and with the results shown in Table 3.

TABLE 3

| Adhesion of X-ray emulsion after incubation | | |
|---|---|---|
| Normal dry adhesion before processing | Normal dry adhesion after processing | Normal wet adhesion |
| Grade 1 | Grade 2 | Grade 1 |

EXAMPLE 22

Example 6 was repeated to produce a biaxially oriented polyethylene terephthalate film having polyester layers suitable for coating with a light-sensitive layer in the production of reprographic films. The aqueous coating dispersion contained 10 g of 'Eastman Binder' DFB in 100 ml of water and was applied to give a dry coating on each side of the film of about 0.2 μm. Aqueous light-sensitive reprographic lacquers comprising a light-sensitive diazonium salt and binders selected from cellulose acetate butyrate, cellulose acetate propionate, cross-linked acrylic resins and cellulose acetate were applied as solutions in an organic solvent over the polyester layers and tested for lacquer adhesion with the results shown in Table 4 in which the numeral 1 represents excellent adhesion and 6 very bad adhesion. For the purposes of comparison, the adhesions of the same lacquers to an uncoated polyethylene terephthalate film were assessed by the same tests with the results also shown in Table 4.

The following abbreviations are used in Table 1:

CAB—cellulose acetate butyrate
CAPr—cellulose acetate propionate
Ac—cross-linked acrylic resin
CA—cellulose acetate

TABLE 4

| | Lacquer adhesion test values | | | |
|---|---|---|---|---|
| | CAB | CAPr | Ac | CA |
| Lacquer adhesion: | | | | |
| to polyester coated film | 5 | 2 | 2 | 3 |
| to uncoated film | 6 | 6 | 4 | 6 |

In every case, the polyester coating enhanced the adhesion of the reprographic lacquers to the film support in comparison with the adhesion to the film which had not been treated with a polyester coating.

EXAMPLES 23 TO 26

In Examples 23 to 26 biaxially oriented polyethylene terephthalate films are coated on both sides with an aqueous dispersion comprising 10 g of an admixture of 'Eastman Binder' DFB and 'Eastman WD Size' in the proportions indicated in Table 5 in 100 ml of water whereas in Example 26 the dispersion included 10 g of 'Eastman WD Size' alone in 100 ml of water. The polyester coatings were dried to a dry coating of about 0.2 μm. The reprographic lacquers described in Example 22 were applied over the resulting polyester coatings and tested for adhesion in the manner described also in Example 22, with the results shown in Table 5.

TABLE 5

| Example | Polyester dispersion (proportions of admixtures quoted by volume) | Lacquer adhesion test values | | | |
|---|---|---|---|---|---|
| | | CAB | CAPr | Ac | CA |
| 23 | 3:1-'Eastman Binder' DFB: 'Eastman WD Size' | 5 | 2 | 2 | 3 |
| 24 | 1:1-'Eastman Binder' DFB: 'Eastman WD Size' | 5 | 1 | 3 | 2 |
| 25 | 1:3-'Eastman Binder' DFB: 'Eastman WD Size' | 3 | 1 | 3 | 1 |
| 26 | 'Eastman WD Size' alone | 4 | 1 | 3 | 1 |

In each of Examples 23 to 26, the adhesion of the reprographic lacquers to the polyethylene terephthalate film was improved by the interposed polyester coating layer in relation to the adhesion obtained by applying the reprographic lacquers directly to the film surface, as recorded in Table 4.

We claim:

1. A process for the production of a light-sensitive photographic film which comprises applying an aqueous dispersion of a synthetic polyester or copolyester derived from the condensation of one or more organic acids having at least three functional acid groups or an anhydride or a lower alkyl ester of such an acid with one or more glycols, which polyester or copolyester contains free-functional acid groups and has an acid number in the range 1 to 120 to one or both surfaces of a film of a synthetic linear polyester, drying said aqueous dispersion to a layer having a dry coat weight in the range 0.1 to 10.0 mg/dm$^2$ and applying a light-sensitive photographic layer over one or both layers applied from the aqueous dispersion of the synthetic polyester or copolyester.

2. A process according to claim 1, wherein said light-sensitive layer comprises a gelatinous silver halide emulsion or a layer containing or impregnated with a light-sensitive diazonium salt.

3. A process according to claim 2, in which the coating polyester or copolyester is derived from one or more organic acids selected from trimellitic acid, pyromellitic acid, trimesic acid, sulphoterephthalic acid, sulphoisophthalic acid, sulphophthalic acid and benzo phenone tetra carboxylic acid, or an anhydride or lower alkyl ester of such an acid.

4. A process according to claim 2, in which the coating polyester or copolyester is derived from one or more glycols selected from ethylene glycol, 1,3-butylene glycol, dipropylene glycol, 1,2-propylene glycol, diethylene glycol, polyethylene glycol, neopentyl glycol, 1,3-propanediol, 1,4-cyclohexanedimethanol, styrene oxide and phenyl glycidyl ether.

5. A process according to claim 2, in which the coating polyester or copolyester is prepared by the reaction of:

trimellitic anhydride with ethylene glycol and benzyl alcohol;

trimellitic anhydride with ethylene glycol, isophthalic acid and benzyl alcohol;

trimellitic anhydride with ethylene glycol, chlorendic anhydride, and benzyl alcohol;

trimellitic anhydride with 1,2-propanediol and cyclohexanol; or sulphoterephthalic acid with ethylene glycol, isophthalic acid, terephthalic acid and neopentyl glycol.

6. A process according to claim 1, in which the aqueous dispersion of the synthetic polyester or copolyester is applied to the film of synthetic linear polyester before or during the stretching operation by which the film is oriented.

7. A process according to claim 6, in which the aqueous dispersion of the synthetic polyester or copolyester is applied to the film after the film has been stretched in the longitudinal direction and before stretching in the transverse direction.

8. A process according to claim 1, in which the or each applied layer of synthetic polyester or copolyester is dried to a coat weight of 1.0 to 2.0 mg/dm$^2$.

9. A process according to claim 1, in which one or more adhesion-promoting or subbing layers is interposed between the polyester or copolyester layer and the light-sensitive layer.

10. A process according to claim 1, in which the applied polyester or copolyester layer is subjected to a modifying corona discharge treatment prior to coating with a further layer.

11. A process according to claim 10, in which the light-sensitive layer is adhered directly to the corona discharge treated polyester or copolyester layer.

12. A process according to claim 1, in which the light-sensitive layer applied over the layer of synthetic polyester or copolyester comprises a light-sensitive photographic emulsion.

13. A process according to claim 1, in which the light-sensitive layer applied over the layer of synthetic polyester or copolyester comprises a resinous binder containing or impregnated with a light-sensitive diazonium salt.

14. A process according to claim 5 in which the coating polyester or copolyester is prepared by the reaction of trimellitic anhydride with ethylene glycol and benzyl alcohol.

* * * * *